US010677558B2

(12) United States Patent
McPherson et al.

(10) Patent No.: US 10,677,558 B2
(45) Date of Patent: Jun. 9, 2020

(54) CROSSBOW TRIGGER WITH ROLLER SEAR

(71) Applicant: MCP IP, LLC, Sparta, WI (US)

(72) Inventors: Mathew A. McPherson, Norwalk, WI (US); Mark J. Hayes, Sparta, WI (US); Jeffrey A. Ozanne, Sparta, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 16/268,390

(22) Filed: Feb. 5, 2019

(65) Prior Publication Data

US 2019/0178602 A1 Jun. 13, 2019

Related U.S. Application Data

(63) Continuation of application No. 15/347,662, filed on Nov. 9, 2016, now Pat. No. 10,197,354.

(60) Provisional application No. 62/254,029, filed on Nov. 11, 2015, provisional application No. 62/317,350, filed on Apr. 1, 2016.

(51) Int. Cl.
*F41B 5/12* (2006.01)
*F41B 5/14* (2006.01)

(52) U.S. Cl.
CPC ..... *F41B 5/1469* (2013.01); *F41B 5/12* (2013.01); *F41B 5/123* (2013.01)

(58) Field of Classification Search
CPC ..... F41B 5/12
See application file for complete search history.

(56) References Cited

U.S. PATENT DOCUMENTS

| | | | |
|---|---|---|---|
| 4,030,473 | A | 6/1977 | Puryear |
| 4,192,281 | A | 3/1980 | King |
| 4,479,480 | A | 10/1984 | Holt |
| 4,693,228 | A | 9/1987 | Simonds et al. |
| 4,716,880 | A | 1/1988 | Adkins |
| 4,877,008 | A | 10/1989 | Troubridge |
| 5,085,200 | A | 2/1992 | Horton-Corcoran |
| 5,596,976 | A | 1/1997 | Waiser |
| 5,598,829 | A | 2/1997 | Bednar |
| 5,649,520 | A | 7/1997 | Bednar |
| 5,884,614 | A | 3/1999 | Darlington |
| 6,205,990 | B1 | 3/2001 | Adkins |
| 6,425,386 | B1 | 7/2002 | Adkins |
| 6,736,123 | B1 | 5/2004 | Summers |
| 6,802,304 | B1 | 10/2004 | Chang |
| 7,174,884 | B2 | 2/2007 | Kempf |
| 7,588,022 | B2 | 9/2009 | Chang |
| 7,770,567 | B1 | 8/2010 | Yehle |
| 8,020,543 | B2 | 9/2011 | Maleski |
| 8,091,540 | B2 | 1/2012 | Matasic |
| 8,522,761 | B1 | 9/2013 | Chu |
| 8,602,013 | B2 | 12/2013 | Bednar |
| 8,651,094 | B2 | 2/2014 | Matasic |
| 8,857,420 | B2 | 10/2014 | Grace |
| 9,010,308 | B1 | 4/2015 | Hyde |
| 9,354,018 | B2 | 5/2016 | Khoshnood |
| 9,360,268 | B2 | 6/2016 | Khoshnood |
| 9,435,605 | B2 | 9/2016 | McPherson et al. |

(Continued)

*Primary Examiner* — John A Ricci

(57) ABSTRACT

In some embodiments, a trigger mechanism comprises a trigger and a latch. The trigger comprises a body, a bearing and a roller. The roller is arranged to rotate with respect to the body. The body supports the bearing and the bearing supports the roller. The roller comprises a trigger sear. The latch comprises a latch sear that is arranged to contact the trigger sear.

19 Claims, 19 Drawing Sheets

(56) References Cited

U.S. PATENT DOCUMENTS

| | | | |
|---|---|---|---|
| 10,197,354 | B2 | 2/2019 | McPherson et al. |
| 2012/0048252 | A1 | 3/2012 | Chu |

CROSSBOW TRIGGER WITH ROLLER SEAR

CROSS-REFERENCE TO RELATED APPLICATIONS

This application claims the benefit and is a continuation of U.S. patent application Ser. No. 15/347,662, filed Nov. 9, 2016, which claims the benefit of U.S. Provisional Patent Application No. 62/254,029, filed Nov. 11, 2015, and the benefit of U.S. Provisional Patent Application No. 62/317,350, filed Apr. 1, 2016, the entire disclosures of which are hereby incorporated herein by reference.

BACKGROUND OF THE INVENTION

This invention relates generally to trigger mechanisms and more specifically to a trigger suitable for use with a crossbow or firearm.

Crossbows are generally known in the art, as well as trigger mechanisms arranged to control the firing of a crossbow. A crossbow can be cocked, wherein a bowstring can be retained in a drawn orientation by a string catch. The crossbow can be fired by operating a trigger, which releases the string catch, thereby releasing the bowstring.

Firearms are generally known in the art, as well as ammunition with chemical propellants. A firearm trigger can comprise a hammer arranged to impact a firing pin.

A trigger assembly can control several aspects of the firing experience when shooting a crossbow or firearm, such as trigger pull weight and trigger travel distance. A trigger will present a certain feedback or feel to the shooter during trigger travel, and a smooth pull is generally preferred over a gritty pull.

There remains a need for novel trigger mechanisms that provide for lightweight, smooth operation and improved trigger feel when compared to traditional triggers.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a trigger mechanism comprises a trigger and a latch. The trigger comprises a body, a bearing and a roller. The roller is arranged to rotate with respect to the body. The body supports the bearing and the bearing supports the roller. The roller comprises a trigger sear. The latch comprises a latch sear that is arranged to contact the trigger sear.

In some embodiments, the roller is supported by a plurality of bearings, and the trigger supports the bearings.

In some embodiments, the latch sear comprises a curved portion.

In some embodiments, the latch sear comprises a surface oriented at an angle to a reference line extending between a trigger rotation axis and a central axis of the roller.

In some embodiments, the trigger comprises a second bearing. The trigger body supports the second bearing. The first and second bearings support the roller.

In some embodiments, the latch sear comprises a curved surface. In some embodiments, the latch sear comprises a first surface oriented at an angle to a second surface.

In some embodiments, a trigger mechanism comprises a trigger, a latch and an assembly comprising a roller and a bearing arranged to support the roller. The latch comprises a string catch. The trigger is moveable between first and second positions. The roller comprises a first sear and the trigger mechanism comprises a second sear. One of the trigger and latch comprises the assembly, and the other of the trigger and latch comprises the second sear.

In some embodiments, the trigger comprises the assembly and the latch comprises the second sear. In some other embodiments, the latch comprises the assembly and the trigger comprises the second sear. In some embodiments, the second sear comprises a curved surface.

In some embodiments, a crossbow trigger comprises a housing, an arrow sensor and an arrow retainer. The arrow sensor is moveable with respect to the housing. The arrow retainer comprises a body arranged to pivot with respect to the housing. A biasing member contacts the arrow sensor and the arrow retainer. In some embodiments, the biasing member is a coil spring positioned between the arrow sensor and the arrow retainer. In some embodiments, the arrow retainer comprising weight lightening apertures.

In some embodiments, a firearm trigger assembly comprises a trigger and a hammer. The trigger is arranged to pivot on a trigger axis and comprises a body, a bearing and a roller. The roller is arranged to rotate with respect to the body. The roller comprises a trigger sear. The hammer is arranged to pivot on a hammer axis and is biased in a predetermined direction. The hammer comprises a hammer sear that is arranged to contact the trigger sear.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
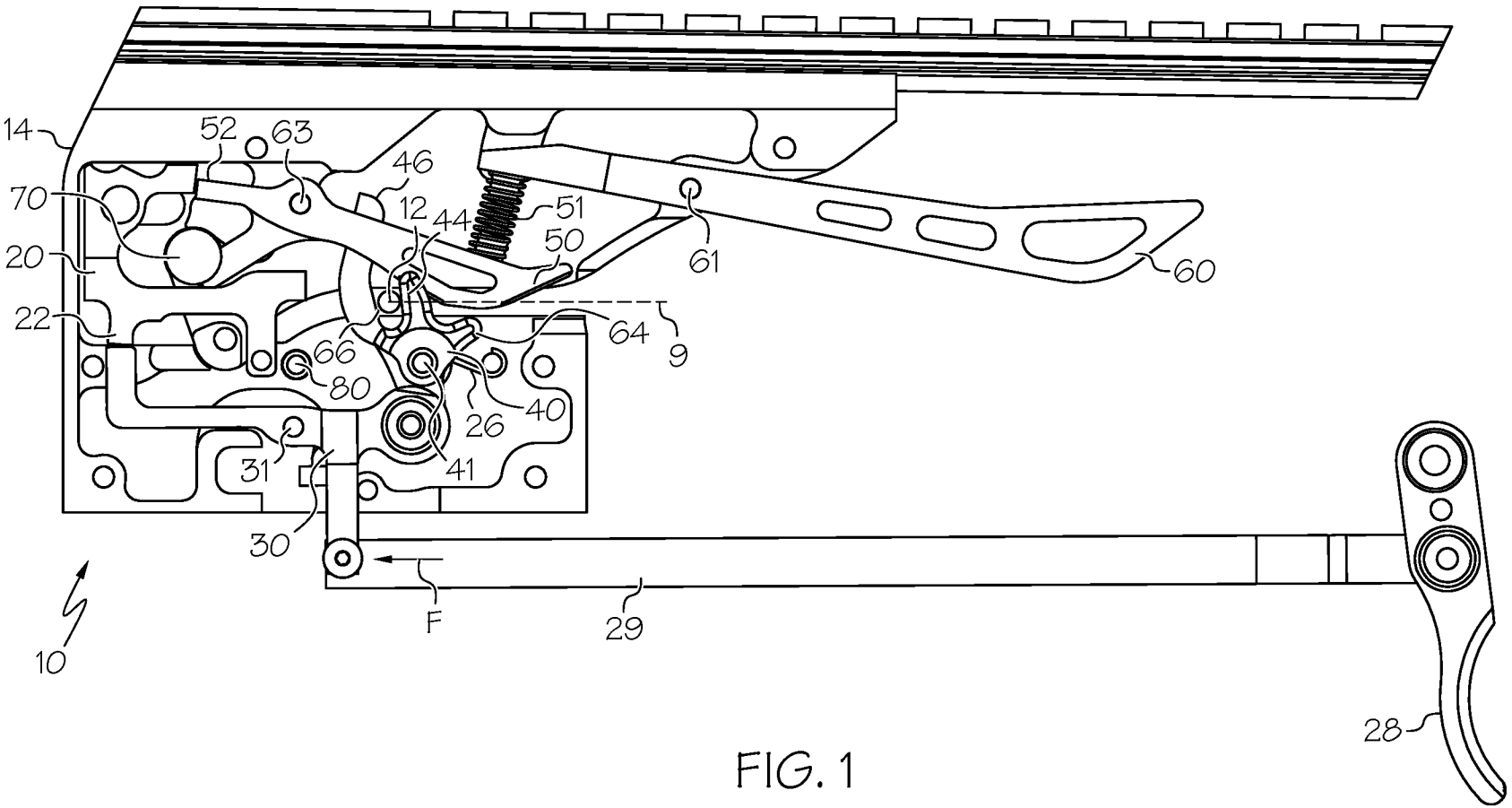
FIG. 1 shows an embodiment of a crossbow trigger assembly.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

Figure 2:
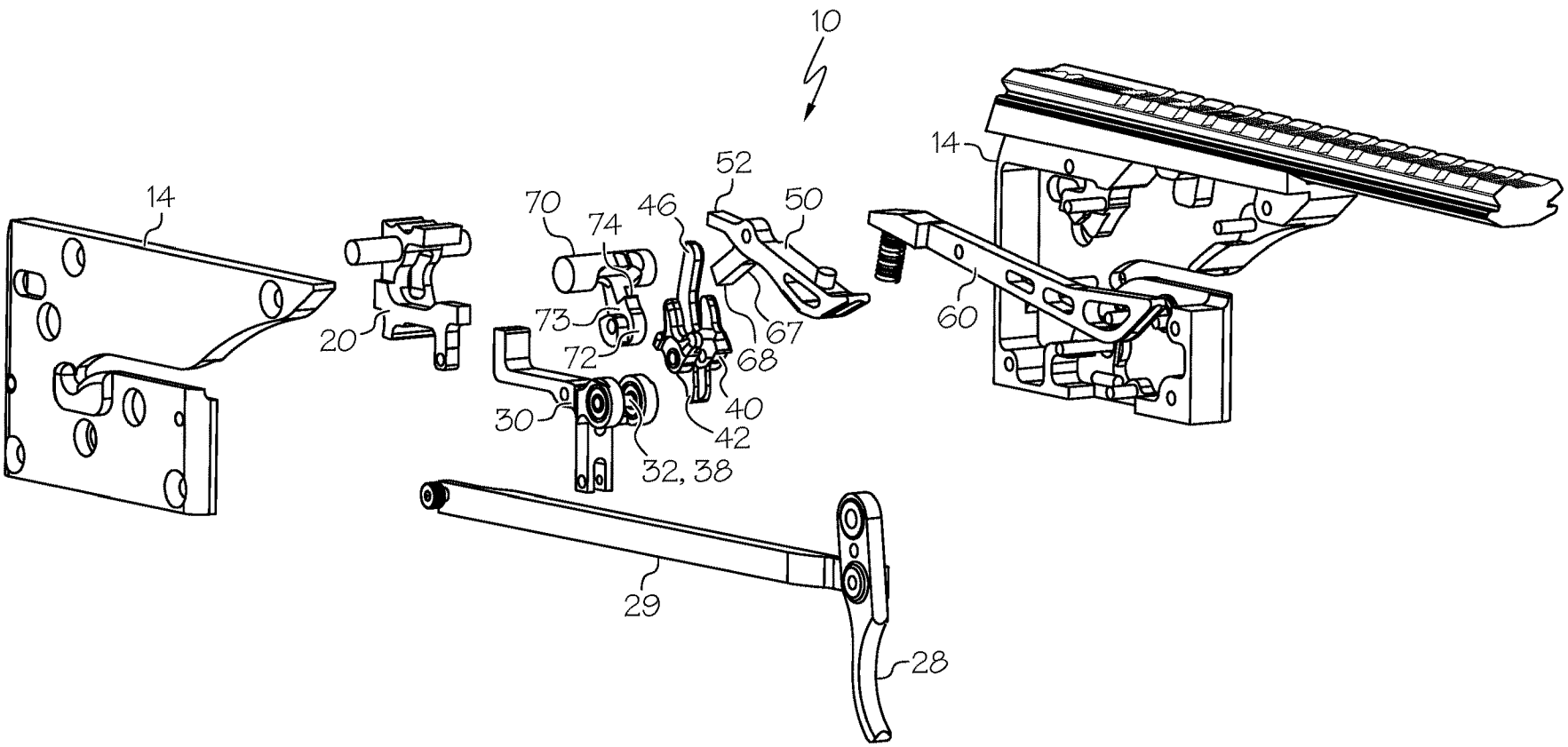
FIG. 2 an exploded view of the trigger assembly shown in FIG. 1.

FIG. 1 shows an embodiment of a crossbow trigger assembly 10. FIG. 2 shows an exploded view of the trigger assembly 10 shown in FIG. 1.

In some embodiments, a trigger assembly 10 comprises a housing 14, a trigger 30, a latch 40, a safety 20, an arrow sensor 50, an arrow retainer 60 and a disengage selector 70. In some embodiments, the trigger assembly 10 comprises a trigger lever 28 operatively engaged with the trigger 30 via linkage 29.

Figure 3:
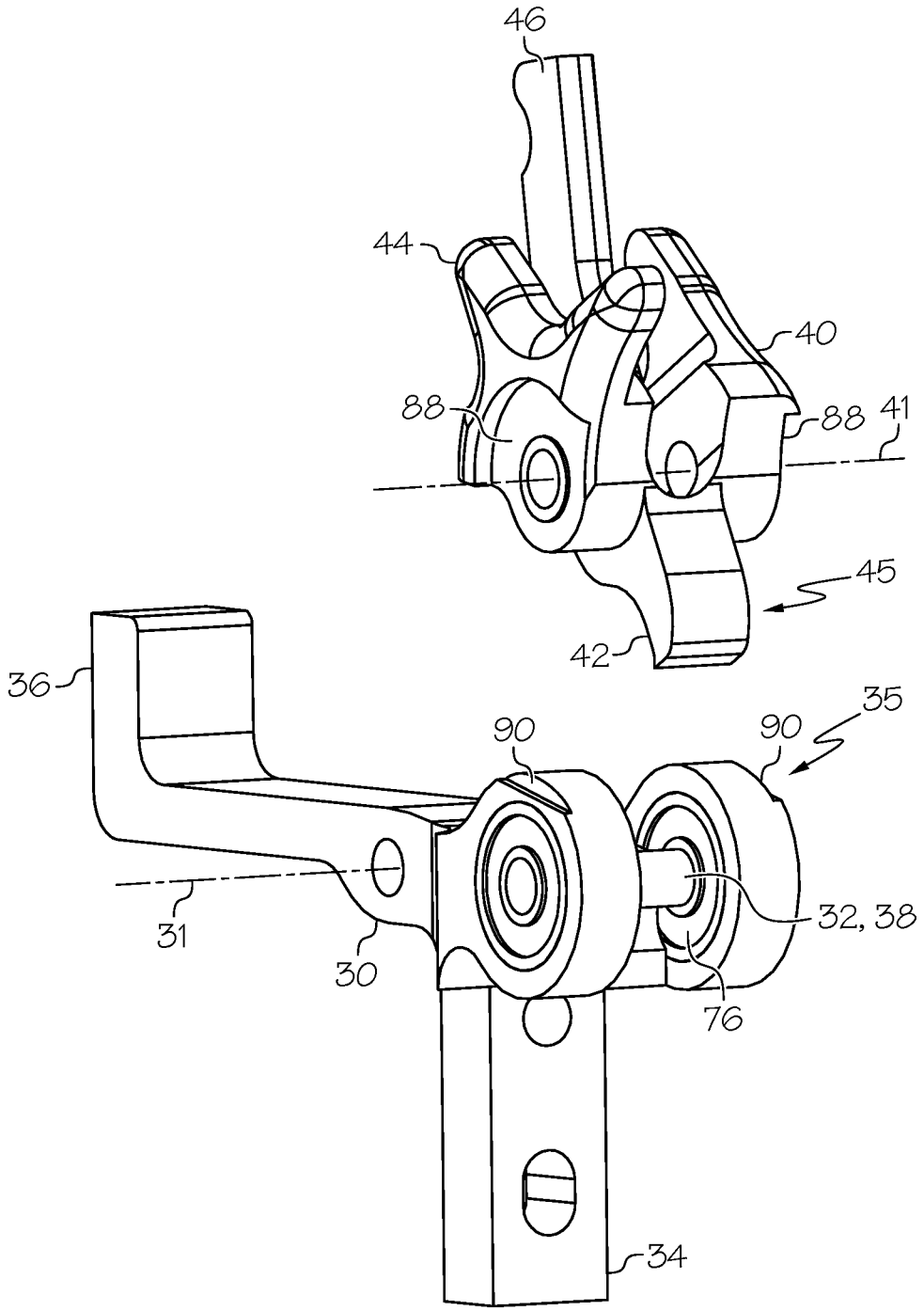
FIG. 3 shows an embodiment of a latch and an embodiment of a trigger.

Referring to FIGS. 2 and 3, desirably the trigger 30 comprises a trigger sear 32 and the latch 40 comprises a latch sear 42. The trigger sear 32 is arranged to contact the latch sear 42 in certain configurations of the trigger assembly 10. Desirably, at least one of the trigger sear 32 and latch sear 42 comprises a roller 38. As shown in FIG. 3, the trigger sear 32 comprises a roller 38 and the latch sear 42 comprises a solid surface that is fixed with respect to the rest of the latch 40.

Desirably, the trigger 30 is arranged to move between first and second positions. In some embodiments, the trigger 30 is arranged to rotate about a trigger axis 31, and the trigger 30 can rotate between the first and second positions. In some embodiments, the trigger 30 comprises a first portion 34 or first arm 34 that is arranged to be actuated by an external force. When a shooter actuates the trigger 30, the shooter applies force, directly or indirectly, to the first portion 34 of the trigger 30. In some embodiments, the trigger 30 comprises a second portion 35 that is arranged to contact the latch 40. In some embodiments the second portion 35 comprises the trigger sear 32. In some embodiments, the trigger 30 comprises a third portion 36 or third arm 36, which is constructed and arranged to contact the safety 20.

Desirably, the latch 40 is arranged to move between at least first and second positions. In some embodiments, the latch 40 is arranged to rotate about a latch axis 41, and the latch 40 can rotate between the first and second positions. In some embodiments, the latch axis 41 is oriented below an arrow shooting axis 9 defined by the crossbow. In some embodiments, the latch 40 comprises a first portion 44 that defines a string catch. Desirably, the first portion 44 of the latch 40 will hold the crossbow string in a cocked orientation when the crossbow is ready to fire. In some embodiments, the latch 40 comprises a second portion 45 that is arranged to contact the trigger 30. In some embodiments, the second portion 45 comprises the latch sear 42. In some embodiments, a latch 40 comprises a third portion 46 or third arm 46.

Figure 4:
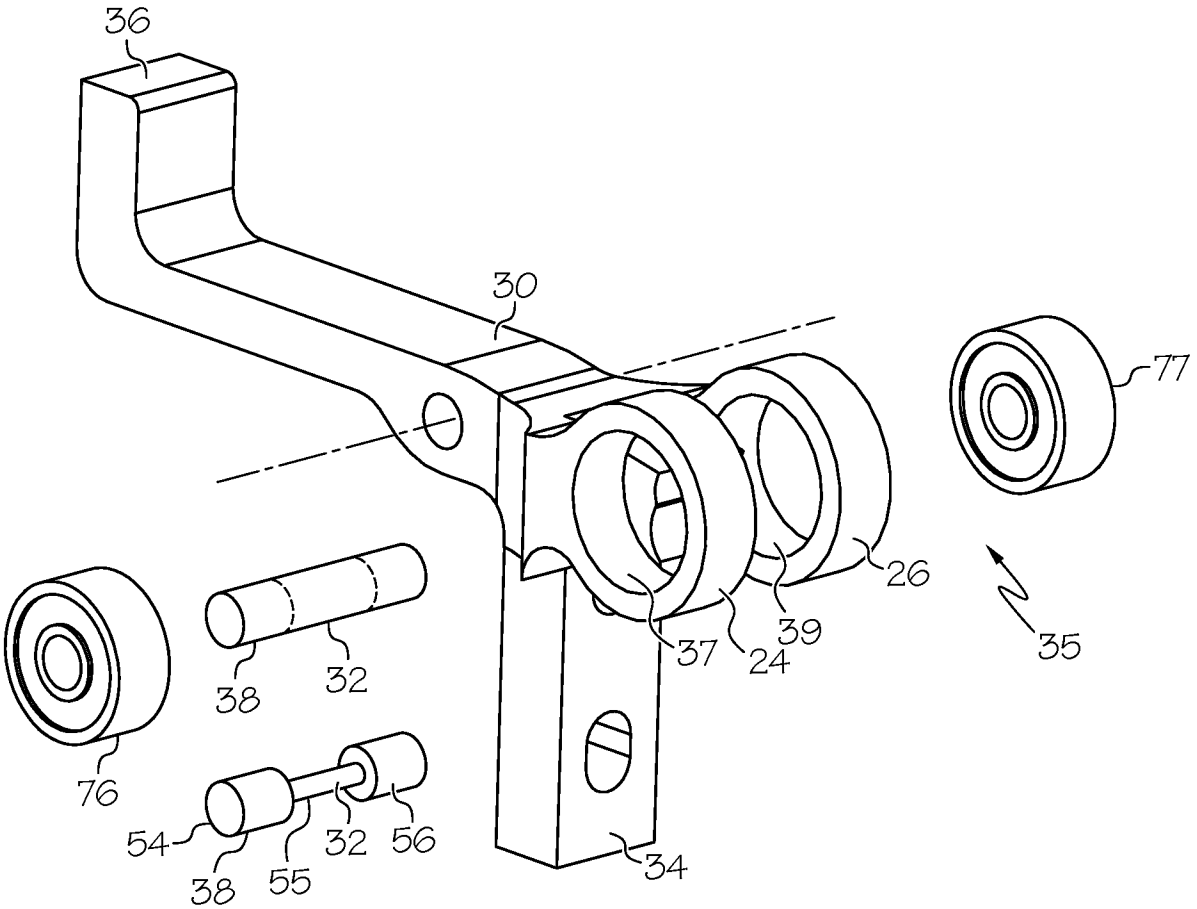
FIG. 4 shows an exploded view of an embodiment of a trigger.

FIG. 4 shows an exploded view of an embodiment of a trigger 30. In some embodiments, the trigger sear 32 comprises a roller 38 such as a shaft or pin, which is arranged to rotate with respect to the trigger 30. In some embodiments, the roller 38 is rotatably supported by the trigger 30.

In some embodiments, a bearing 76 is used between the trigger 30 and roller 38, for example to reduce friction or rolling resistance. In various embodiments, a bearing 76 can comprise roller bearings, needle bearings, ball bearings, etc. A bearing 76 can also comprise a plain bearing, sleeve bearing or the like. In some embodiments, a bearing 76 comprises a low friction material such as PTFE or other suitable polymers, polymer composites such as PTFE with added fillers such as bronze, nylon, suitable metals, etc. In some embodiments, the trigger 30 supports a bearing 76 and the bearing 76 supports the roller 38.

In some embodiments, a trigger 30 supports a roller 38 directly, without the use of a bearing 76.

In some embodiments, the trigger 30 defines a housing 24 for a bearing 76, for example comprising an aperture 37 arranged to receive a bearing 76.

In some embodiments, a trigger 30 comprises a first bearing 76 and a second bearing 77 arranged to collectively support a roller 38. In some embodiments, the first bearing 76 receives a first end of the roller 38 and the second bearing 77 receives a second end of the roller 38. In some embodiments, the two bearings 76, 77 support the roller 38 on opposite sides of the trigger sear 32 portion of the roller 38. In some embodiments, a trigger 30 comprises a first housing 24 defining a first aperture 37 arranged to support a first bearing 76, and a second housing 26 defining a second aperture 39 arranged to support a second bearing 77. In some embodiments, the first aperture 37 and second aperture 39 comprise mirrored shapes arranged on opposite sides of the trigger sear 32.

The trigger assembly 10 disclosed herein, for example wherein a sear surface comprises a roller 38 and the roller 38 is rotatably attached to a trigger 30 (or alternatively a latch 40), provides for a roller sear trigger that does not have any free floating roller parts. In some embodiments, the roller 38 is captured by the trigger 30. Further, by using a roller 38 that is supported via one or more bearings 76, the size (e.g. diameter) of the roller sear can be minimized.

In some embodiments, the trigger 30 defines a body portion comprising a single piece of material. In some embodiments, the first portion 34 and housing portions 24, 26 defining apertures 37, 39 comprise a single piece of material. In some embodiments, the single piece of material further includes the third portion 36.

In some embodiments, the roller 38 changes in size along its length, for example changing in diameter. In some embodiments, a roller 38 comprises a first portion 54 and a second portion 55, wherein the first portion 54 has a different size than the second portion 55. In some embodiments, the second portion 55 comprises a smaller diameter than the first portion 54. In some embodiments, the first portion 54 is received in a bearing 76 and the second portion 55 comprises a sear 32. In some embodiments, the roller 38 comprises a third portion 56. In some embodiments, the third portion 56 and the first portion 54 have similar diameters.

Referring again to FIG. 3, in some embodiments, the latch 40 can be supported by a shaft that is supported by bearings (not illustrated). Any suitable type of bearing(s) can be used and in some embodiments, the latch 40 bearing(s) are similar to the trigger bearing(s) 76. In some embodiments, latch bearings(s) are supported by the housing. In some embodiments, the latch 40 defines one or more bearing recesses 88.

In some embodiments, the trigger 30 comprises one or more recesses 90 to provide for clearance of the latch bearings.

Figure 5:
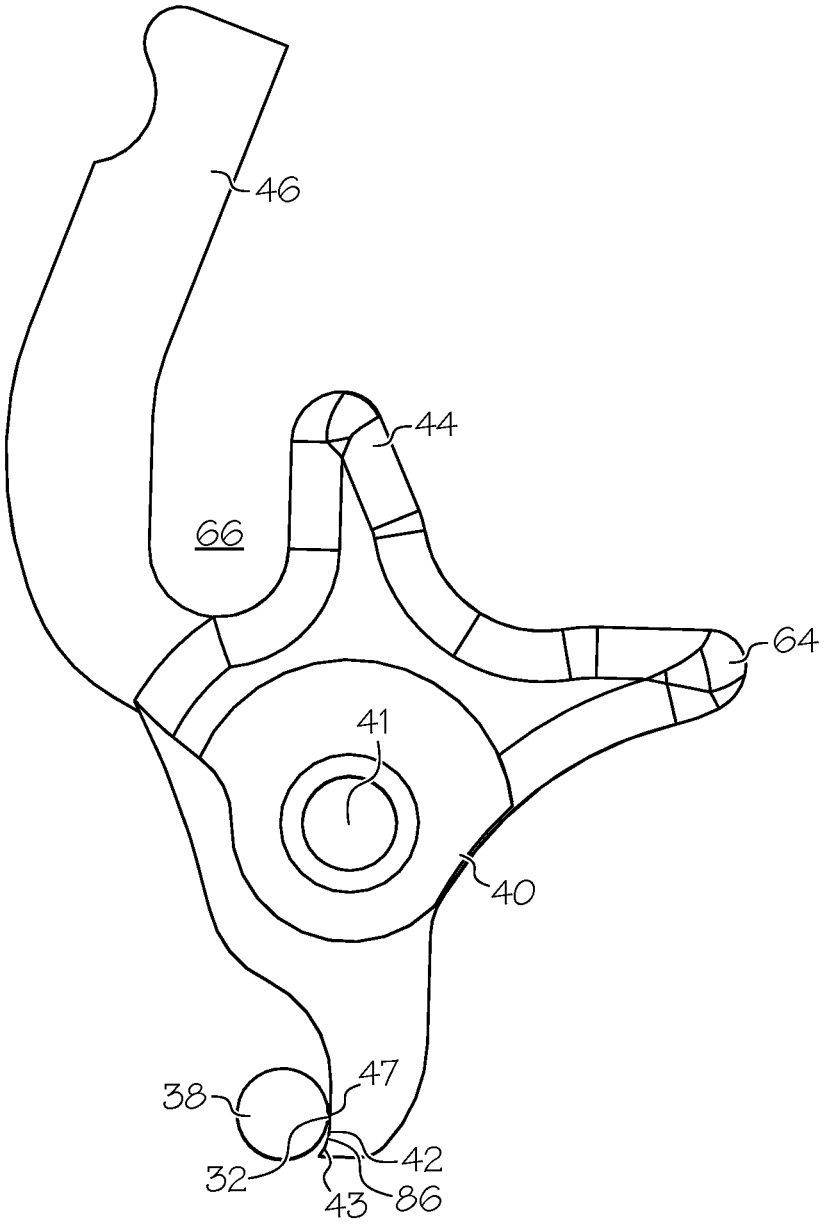
FIG. 5 shows an embodiment of a latch.

FIG. 5 shows an embodiment of a latch 40 and a roller 38 comprising a trigger sear 32.

In some embodiments, the latch 40 comprises a single piece of material. In some embodiments, at least the first portion 44 and the latch sear 42 are formed from a single piece of material.

In various embodiments, the latch sear 42 can have any suitable shape. Different specific shapes in the terminal/distal portion of the latch sear 42 can influence trigger feel and trigger pull weight.

In some embodiments, the latch sear 42 comprises a curved surface portion 43. In some embodiments, the curved surface portion 43 is concave with respect to the roller 38 when the roller 38 abuts the latch sear 42. In some embodiments, the latch sear 42 extends straight in a direction parallel to the latch axis 41 and further comprises curvature about an axis that is oriented parallel to the latch axis 41.

In some embodiments, the latch sear 42 comprises a flat portion 47 that transitions into a distal curved portion 43. In some embodiments, a radius of curvature of the curved portion 43 is less than a radius of curvature of the roller 38. In some embodiments, a radius of curvature of the curved portion 43 is equal to a radius of curvature of the roller 38. In some embodiments, a radius of curvature of the curved portion 43 is greater than a radius of curvature of the roller 38.

A curved surface portion 43 of a sear 42 can be used to influence the trigger pull weight.

In some embodiments, the latch sear 42 comprises a valley 86, for example the sear surface can form a valley with respect to the trigger axis 31. In some embodiments, when the crossbow is cocked, the trigger sear 32 will rest in the valley 86. In some embodiments, if the trigger 30 is pulled enough to move the trigger sear 32 a portion of its travel along the latch sear 42 but not enough to fire the crossbow, and then the trigger is released, the trigger 30 will move back to the original position wherein the trigger sear 32 rests in the valley 86. Thus, a valley 86 can be used to set the distance of trigger pull to fire.

Figure 6:
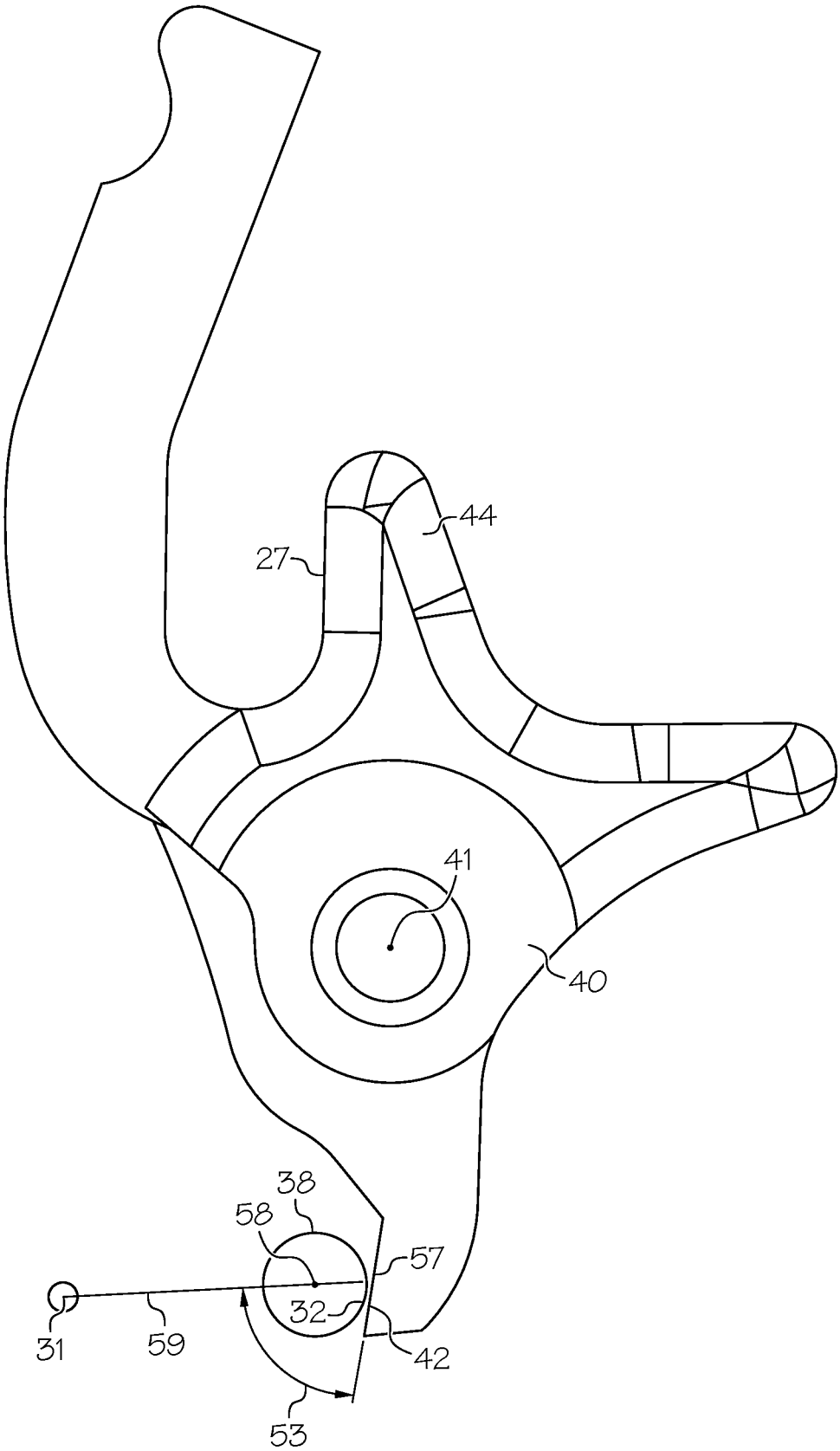
FIG. 6 shows another embodiment of a latch.

FIG. 6 shows another embodiment of a latch 40. In some embodiments, a latch sear 42 comprises a planar surface 57. In some embodiments, the latch sear 42 is angled with respect to the roller 38. In some embodiments, the planar surface 57 is angled with respect to the roller 38. In some embodiments, the string catch surface(s) 27 define a plane, for example a vertical plane oriented orthogonal to the shooting axis, and the latch sear 42 planar surface 57 extends at a non-zero angle to the string catch surface(s) 27 and the vertical plane.

In some embodiments, a reference line 59 extends through the trigger axis 31 and a central axis 58 of the roller 38. In some embodiments, the reference line 59 intersects the latch sear 42. In some embodiments, the reference line 59 is oriented at an angle 53 to the latch sear 42. In some embodiments, the reference line 59 is oriented at an angle 53 to the planar surface 57. The angle 53 can comprise any suitable angle. In some embodiments, the angle 53 is less than 90 degrees. In some embodiments, the angle 53 is less than 85 degrees and greater than 10 degrees. In some embodiments, the angle 53 is less than 80 degrees and greater than 10 degrees. In some embodiments, the angle 53 is less than 80 degrees and greater than 45 degrees.

It can be recognized that in certain embodiments of a trigger 30, for example wherein the trigger rotates about an axis 31, that the roller 38 will travel along an arcuate path as the trigger is actuated. If the shape of the latch sear 42 matches the shape of the trigger sear 32 travel path, the structure of the trigger mechanism will not add trigger pull weight. If the shape of the latch sear 42 is such that an end portion of the sear surface is located closer to the trigger axis 31 than a mid-portion of the sear surface, then the trigger pull weight can be increased due to movement of the latch during trigger pull. For example, if the latch sear 42 surface is oriented such that it would interfere with the travel path of the trigger sear 32, then the latch 40 can rotate about its axis 41 as the trigger 30 is pulled—this results in slightly more crossbow string being drawn as the latch 40 rotates slightly during trigger pull. The shape of the latch sear 42 can influence trigger pull weight.

Referring again to FIG. 1, the trigger assembly 10 is shown with the bowstring 12 in a drawn orientation and being retained in position by the latch 40. The catch 44 portion of the latch 40 contacts the bowstring 12, while the latch sear 42 contacts the trigger sear 32 (see e.g. FIG. 5).

In some embodiments, an arrow retainer 60 is provided, for example to hold an arrow in position on the crossbow. In some embodiments, the arrow retainer 60 comprises a solid body that is supported by the housing 14 and arranged to move with respect to the housing 14. In some embodiments, the arrow retainer 60 pivots with respect to the housing 14 about a retainer axis 61. A biasing member 51 such as a spring can bias the arrow retainer 60 into its ordinary at-rest position. In some embodiments, the biasing member 51 contacts the housing. In some embodiments, the biasing member 51 contacts another moving component of the trigger mechanism, such as the arrow sensor 50.

In some embodiments, the arrow sensor 50 is arranged to move with respect to the housing 14 between first and second positions. In some embodiments, the arrow sensor 50 is arranged to pivot with respect to the housing 14 about a sensor axis 63. A biasing member 51 such as a spring can bias the arrow sensor 50 to the first position as shown in FIG. 1. In some embodiments, a biasing member 51 contacts the housing 14.

In some embodiments, the biasing member 51 contacts the arrow sensor 50 and also contacts the arrow retainer 60. In some embodiments, the biasing member 51 simultaneously biases the arrow sensor 50 and the arrow retainer 60 to their respective first positions. In some embodiments, the arrow retainer 60 comprises an engagement feature, such as a protrusion, arranged to engage the biasing member 51. In some embodiments, the arrow sensor 50 comprises an engagement feature, such as a protrusion, arranged to engage the biasing member 51.

The arrow sensor 50 desirably comprises a safety contacting portion 52. When the arrow sensor 50 is in the first position (e.g. no arrow present), the safety contacting portion 52 is oriented to prevent operation of the safety 20, for example by contacting the safety 20 and preventing movement of the safety 20.

Desirably, the safety 20 is arranged to move with respect to the housing 14 between first and second positions. In some embodiments, the safety 20 is arranged to slide with respect to the housing 14. Desirably, the safety 20 comprises a trigger contacting portion 22. When the safety 20 is in the first position (e.g. a safe/no-fire position) as shown in FIG.

1, the trigger contacting portion 22 is oriented to prevent operation of the trigger 30, for example by contacting the trigger 30 to prevent movement of the trigger 30.

Figure 7:
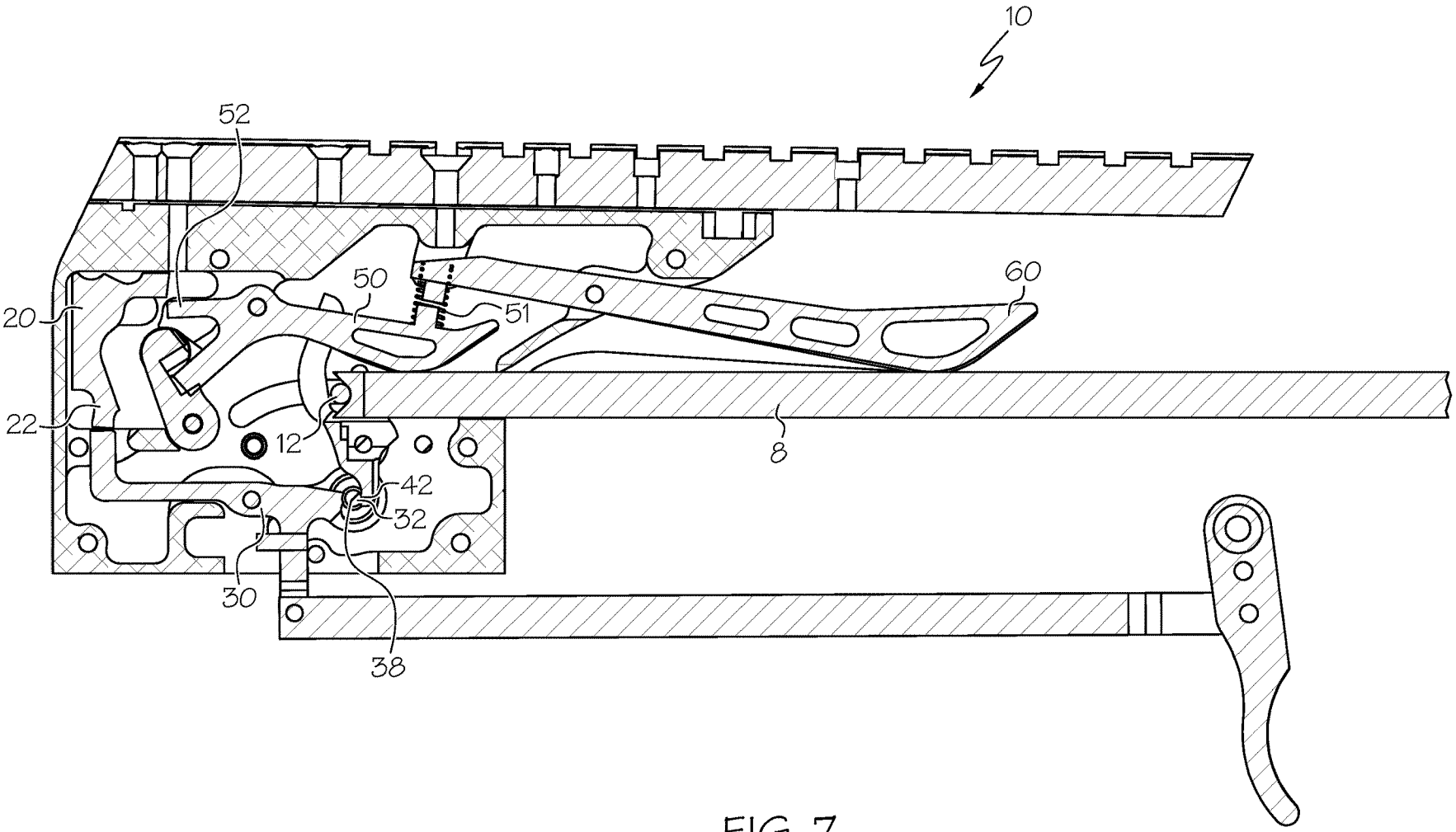
FIG. 7 shows a sectional view of an embodiment of a crossbow trigger assembly.

FIG. 7 shows a cross-sectional view of an embodiment of a trigger assembly 10. An arrow 8 is shown loaded into the trigger assembly 10. The presence of the arrow 8 moves the arrow sensor 50 into its second position, and the safety contacting portion 52 has moved and will not interfere with operation of the safety 20.

FIG. 7 shows the roller 38 that comprises the trigger sear 32 in contact with the latch sear 42. The trigger 30 is in its first position.

Figure 8:
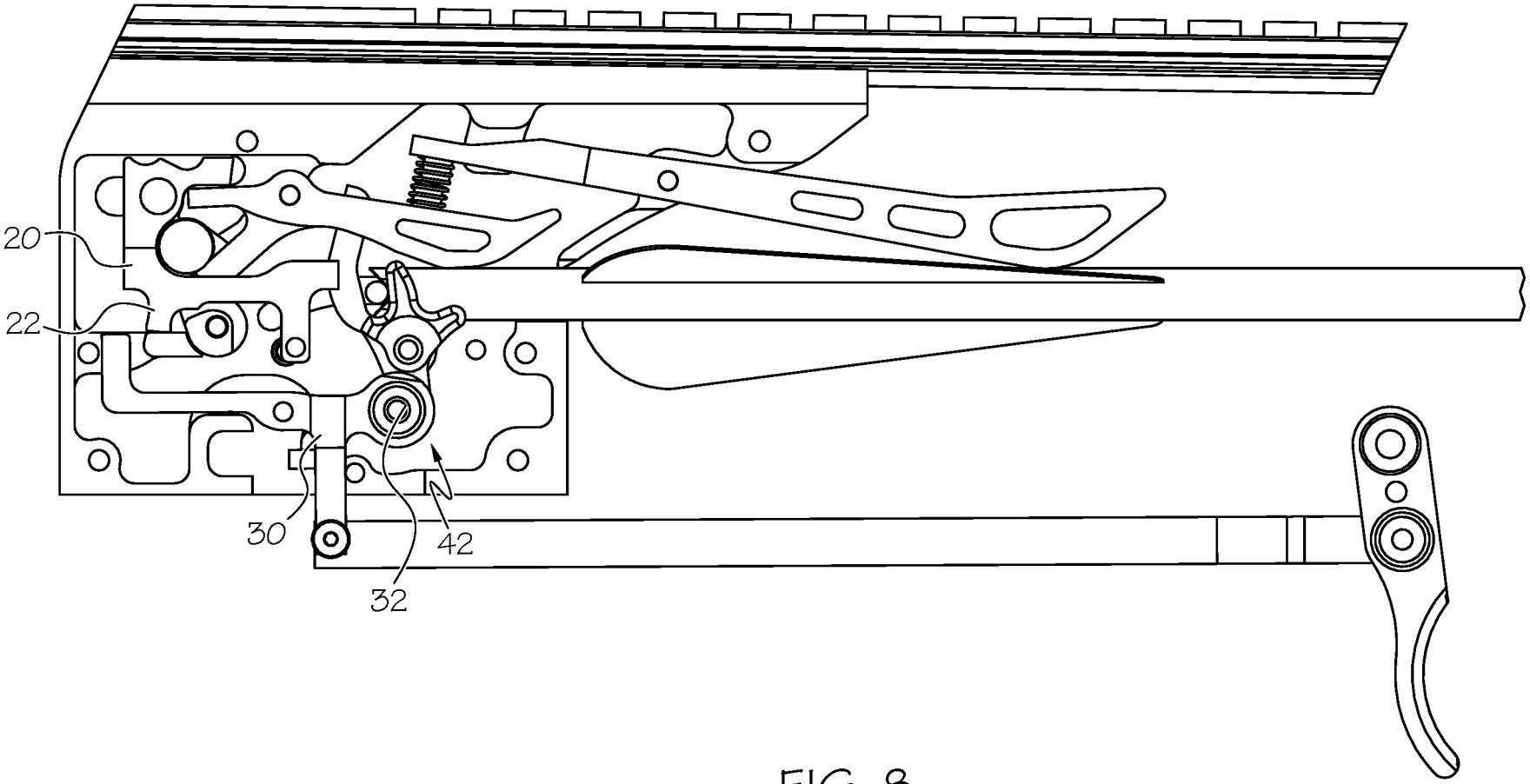
FIG. 8 shows an embodiment of a crossbow trigger assembly in a ready to fire orientation.

FIG. 8 shows an embodiment of a trigger assembly 10 in a ready-to-fire orientation. The safety 20 has been moved into its second position, and the trigger contacting portion 22 is no longer positioned to interfere with the trigger 30. Thus, the trigger 30 can be actuated, wherein the trigger sear 32 will clear the latch sear 42, allowing the arrow 8 to launch.

Figure 9:
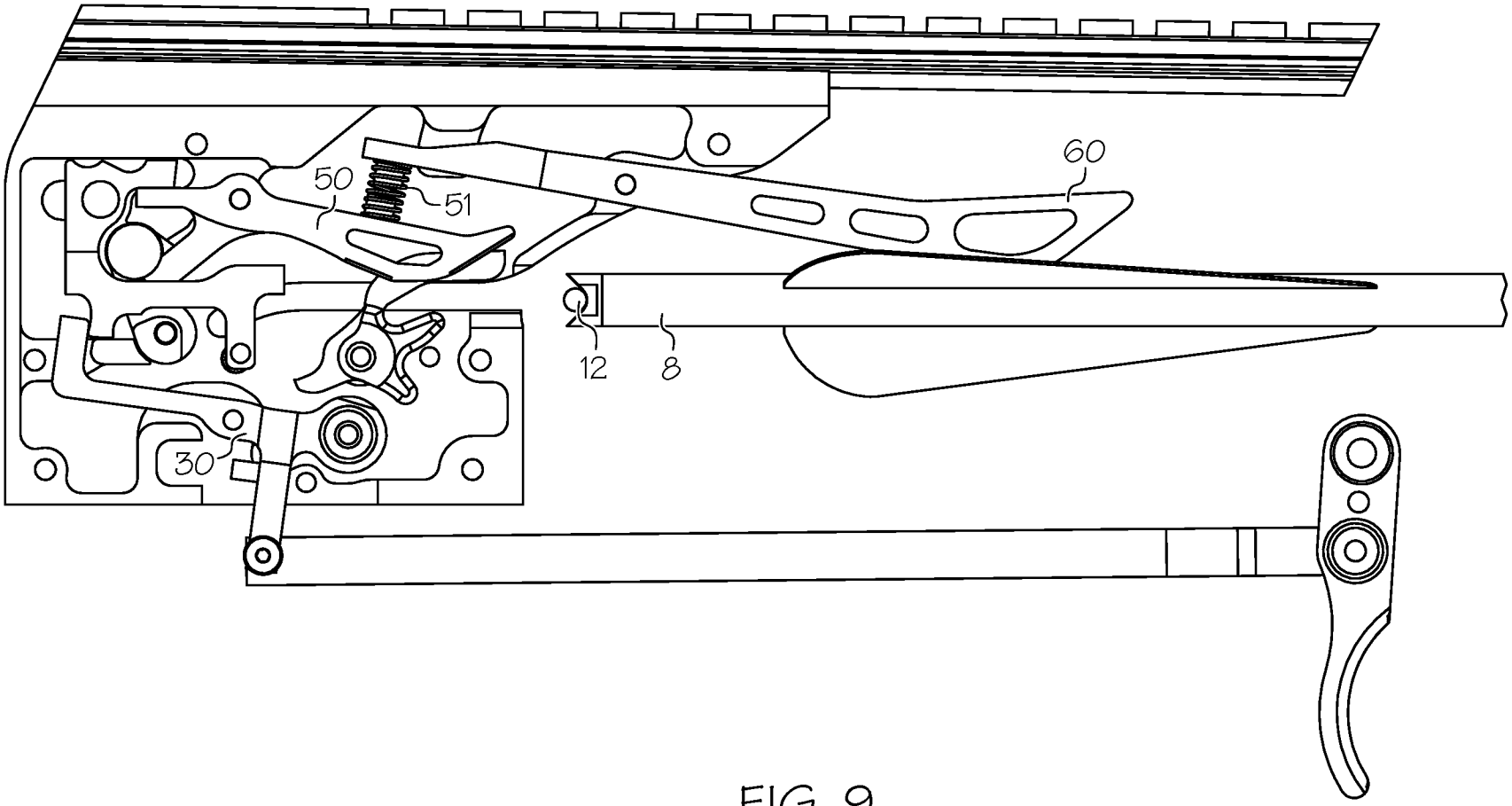
FIG. 9 shows an embodiment of a crossbow trigger assembly shortly after firing.

FIG. 9 shows an embodiment of the trigger assembly 10 after the trigger 30 has been operated and moved to its second position. The trigger sear 32 has cleared the latch sear 42, allowing the latch 40 to pivot forward, releasing the bowstring 12.

The arrow 8 is shown in a position where it has cleared the arrow sensor 50 but it has not yet cleared the arrow retainer 60. In the arrangement shown where the biasing member 51 applies force to both the arrow sensor 50 and arrow retainer 60, the amount of force applied to the arrow 8 by the arrow retainer 60 is reduced when the arrow 8 clears the arrow sensor 50.

Figure 10:
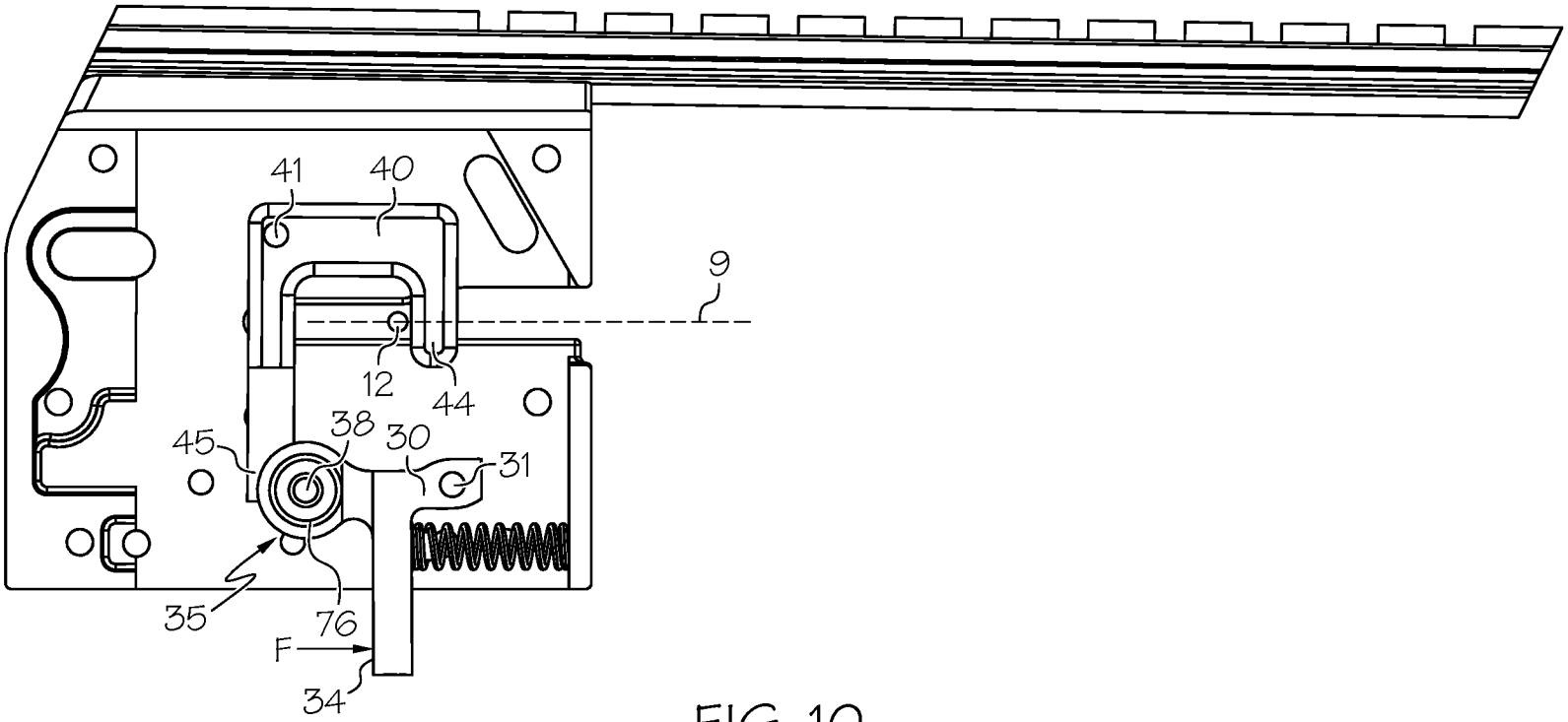
FIGS. 10 and 11 show another embodiment of a trigger assembly.
Figure 11:
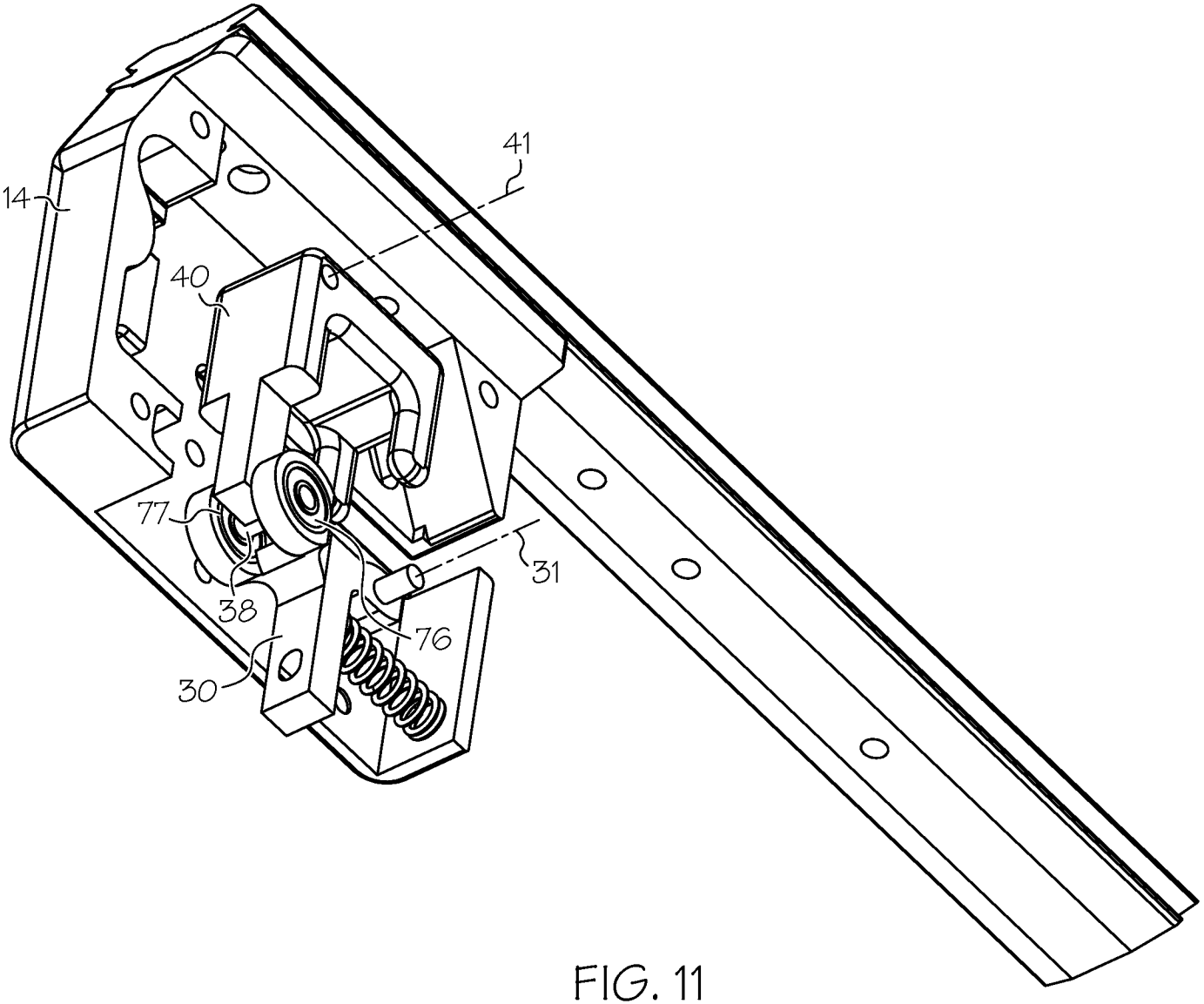
Figure 12:
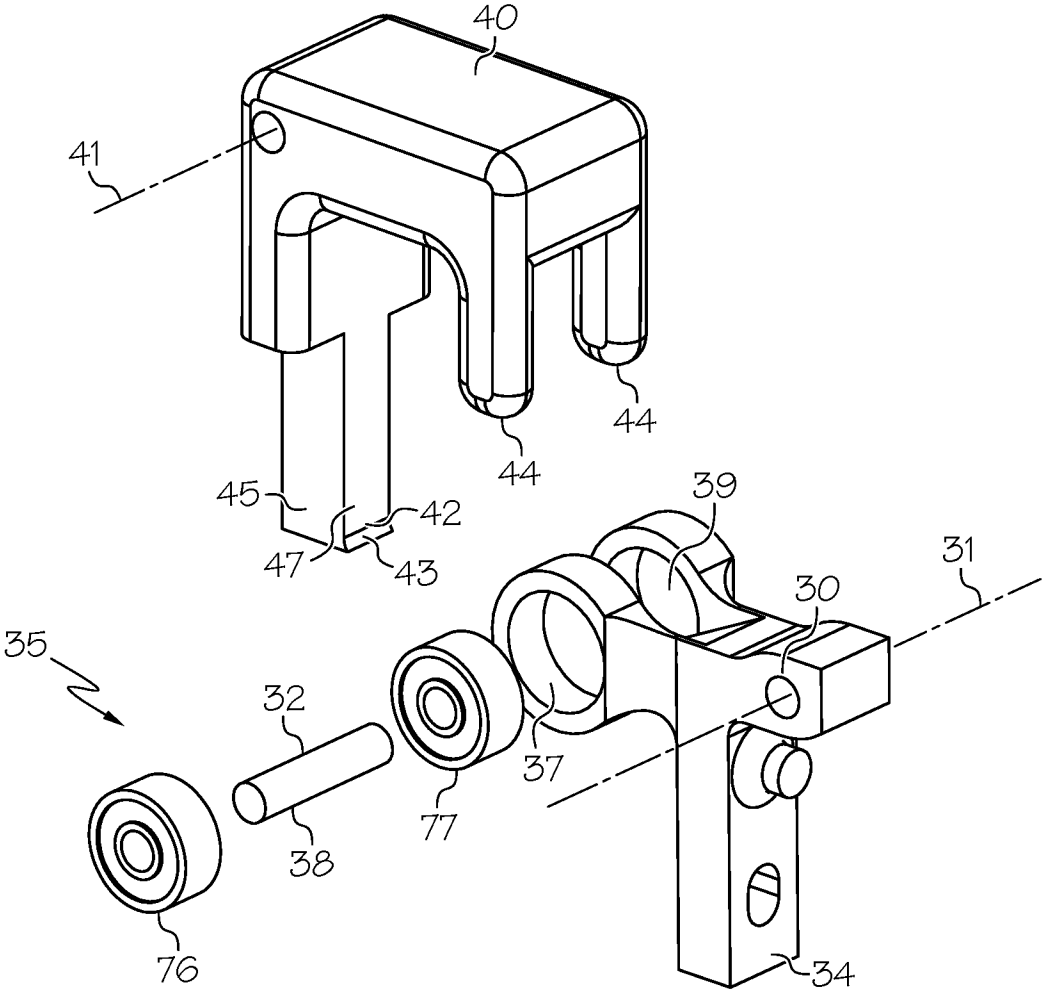
FIG. 12 shows an exploded view of the trigger and latch of the embodiment of FIG. 10.

FIGS. 10 and 11 show another embodiment of a trigger assembly 10. FIG. 12 shows an exploded view of the trigger 30 and latch 40 of the embodiment illustrated in FIGS. 10 and 11.

In some embodiments, a trigger 30 is arranged to pivot on a trigger axis 31 and a latch 40 is arranged to pivot on a latch axis 41. In some embodiments, the latch axis 41 is located above an arrow shooting axis 9 defined by the crossbow. The trigger 30 comprises a first portion 34 wherein a force can be applied to operate the trigger 30 and a second portion 35 that comprises a trigger sear 32. The latch 40 comprises a first portion 44 arranged to retain a crossbow string 12 and a second portion 45 that comprises a latch sear 42.

In some embodiments, the trigger sear 32 comprises a roller 38 such as a pin, which is arranged to rotate with respect to the trigger 30. In some embodiments, the roller 38 is rotatably supported by the trigger 30. In some embodiments, a bearing 76 is used between the trigger 30 and roller 38, for example to reduce friction or rolling resistance. For example, in some embodiments, the trigger 30 supports a bearing 76, such as a roller bearing, and the bearing 76 supports the roller 38.

In some embodiments, the trigger 30 defines a housing for a bearing 76, for example comprising an aperture 37 arranged to receive a bearing 76.

In some embodiments, a trigger 30 comprises a first bearing 76 and a second bearing 77 arranged to collectively support a roller 38. In some embodiments, the first bearing 76 receives a first end of the roller 38 and the second bearing 77 receives a second end of the roller 38. In some embodiments, the two bearings 76, 77 support the roller 38 on opposite sides of the trigger sear 32 portion of the roller 38. In some embodiments, a trigger 30 comprises a first aperture 37 arranged to support a first bearing 76 and a second aperture 39 arranged to support a second bearing 77. In some embodiments, the first aperture 37 and second aperture 39 comprise mirrored shapes arranged on opposite sides of the trigger sear 32.

In some embodiments, the latch sear 42 comprises a curved surface portion 43. In some embodiments, the curved surface portion 43 is concave with respect to the roller 38 when the roller 38 abuts the latch sear 42. In some embodiments, the latch sear 42 extends straight in a direction parallel to the latch axis 41 and further comprises curvature oriented about the latch axis 41. In some embodiments, the latch sear 42 comprises a flat portion 47 that transitions into a distal curved portion 43. In some embodiments, a latch sear 42 comprises a planar portion oriented at an angle as discussed herein with respect to FIG. 6.

Figure 13:
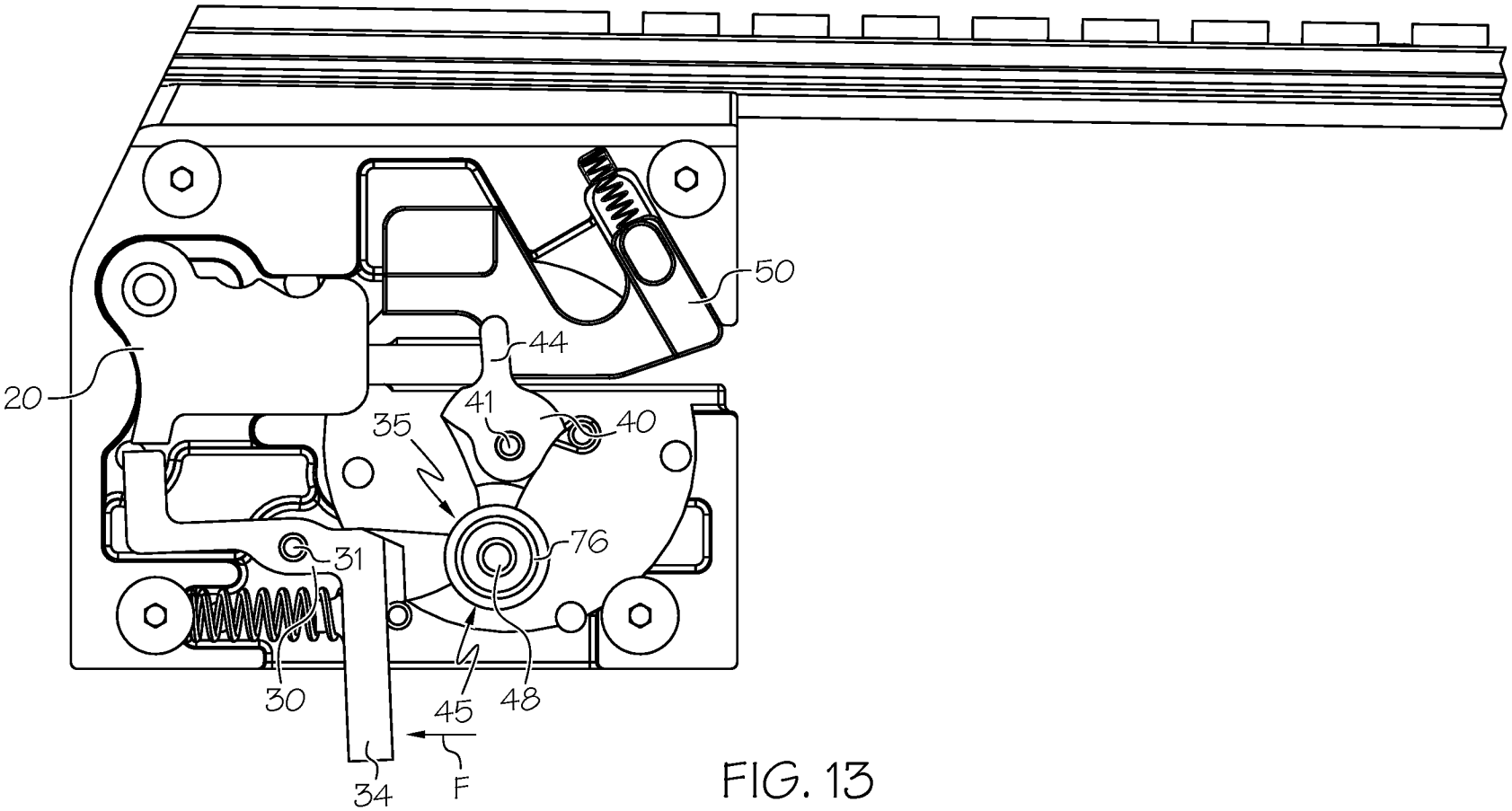
FIGS. 13 and 14 show another embodiment of a trigger assembly.
Figure 14:
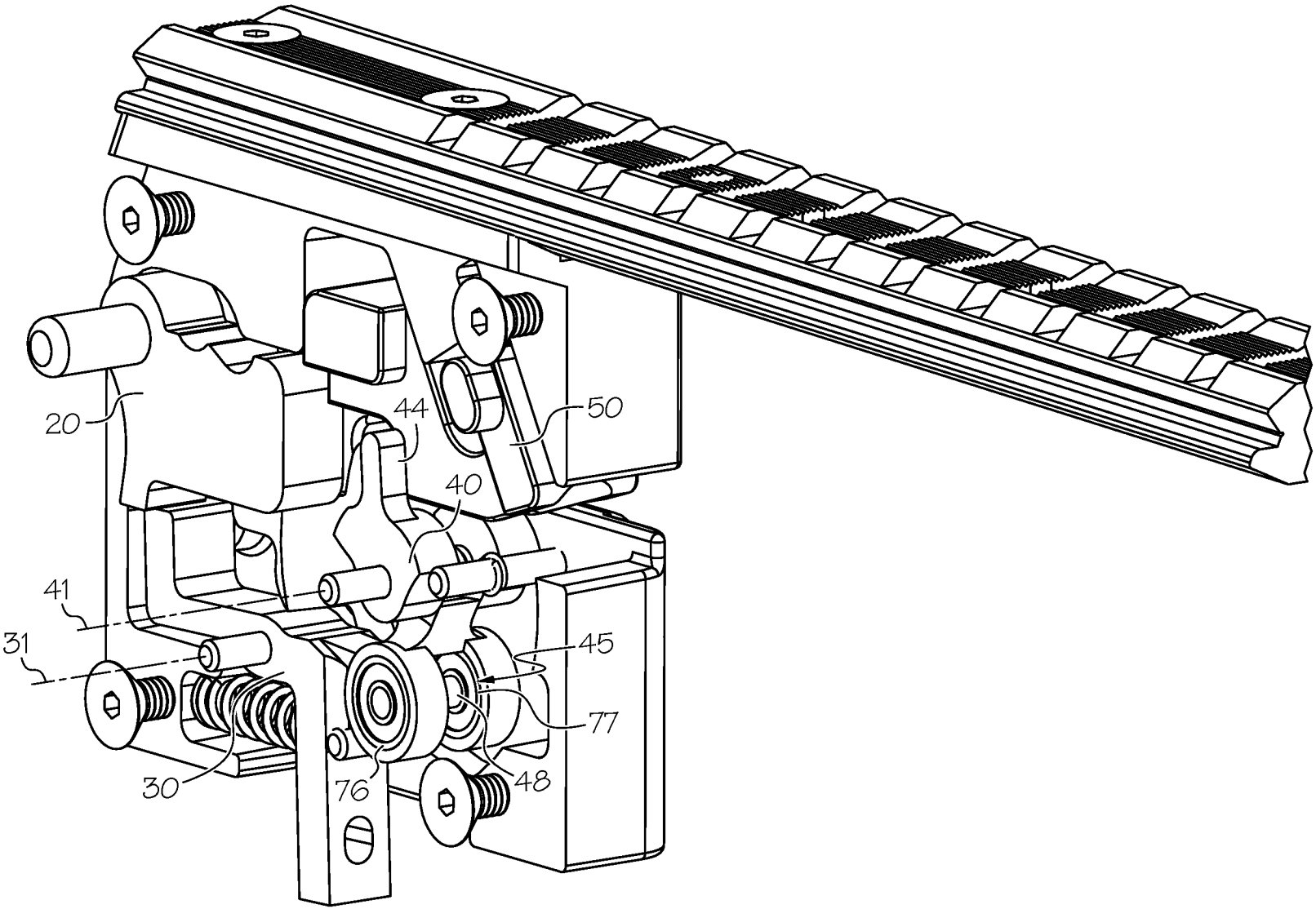
Figure 15:
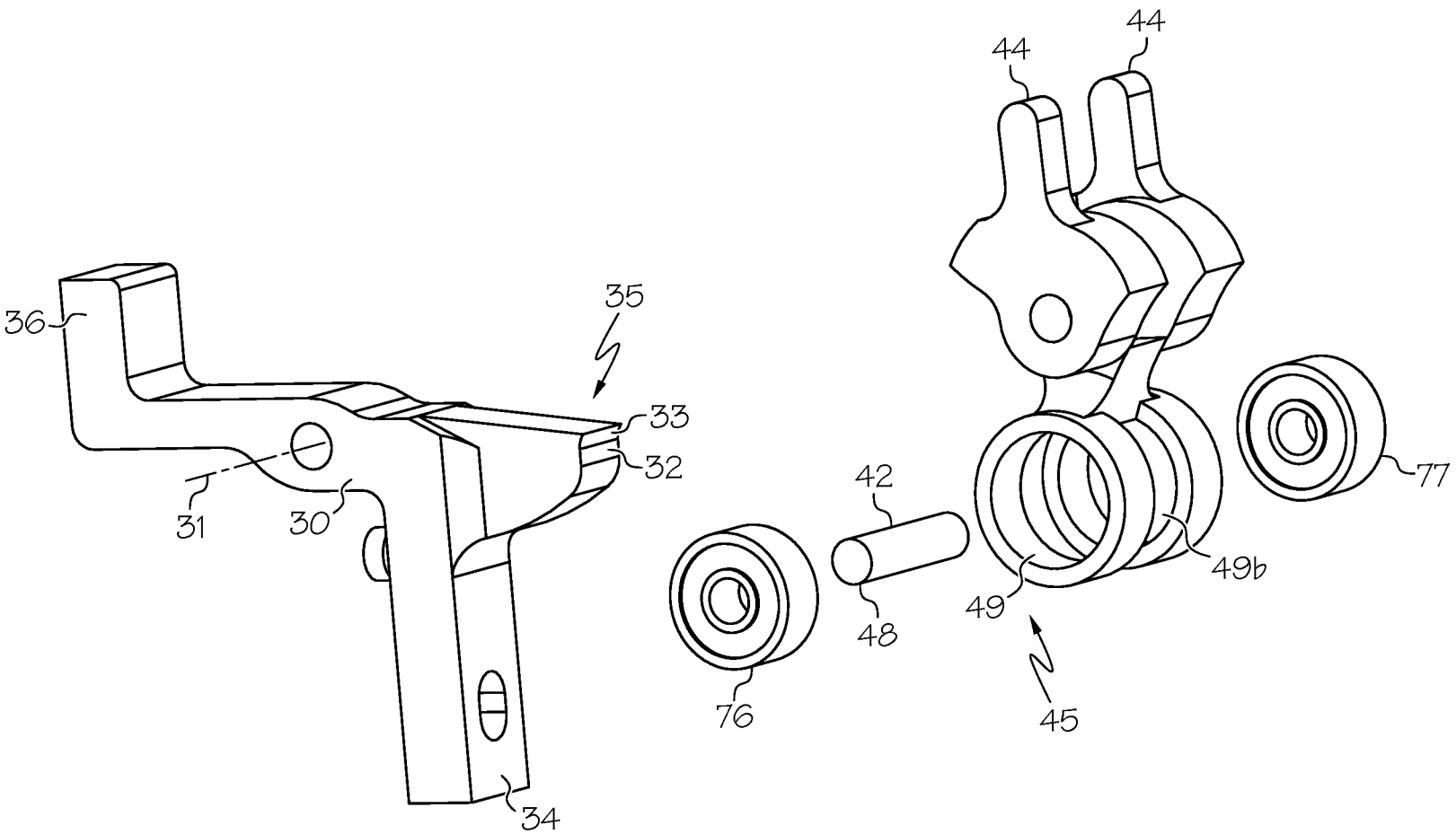
FIG. 15 shows an exploded view of the trigger and latch of the embodiment of FIG. 13.

FIGS. 13 and 14 show another embodiment of a trigger assembly 10, wherein the latch 40 comprises a roller 48 that comprises a latch sear 42. FIG. 15 shows an exploded view of the trigger 30 and latch 40 of the embodiment illustrated in FIGS. 13 and 14.

In some embodiments, a trigger 30 is arranged to pivot on a trigger axis 31 and a latch 40 is arranged to pivot on a latch axis 41. The trigger 30 comprises a first portion 34 wherein a force can be applied to operate the trigger 30 and a second portion 35 that comprises a trigger sear 32. In some embodiments, the trigger 30 comprises a single piece of material. In some embodiments, the first portion 34 and second portion 35 comprise a single piece of material.

In some embodiments, the trigger sear 32 comprises a curved surface portion 33. In some embodiments, the curved surface portion 33 is concave with respect to the latch roller 48 when the roller 48 abuts the trigger sear 32. In some embodiments, the trigger sear 32 extends straight in a direction parallel to the trigger axis 31. In some embodiments, the trigger sear 32 comprises a flat portion that transitions into a distal curved portion 33.

In some embodiments, the latch 40 comprises a first portion 44 arranged to retain a crossbow string 12 and a second portion 45 that comprises a latch sear 42.

In some embodiments, the latch sear 42 comprises a roller 48 such as a pin, which is arranged to rotate with respect to the latch 40. In some embodiments, the roller 48 is rotatably supported by the latch 40. In some embodiments, a bearing 76 is used between the latch 40 and roller 48, for example to reduce friction or rolling resistance. For example, in some embodiments, the latch 40 supports a bearing 76, such as a roller bearing, and the bearing 76 supports the roller 48.

In some embodiments, the latch 40 defines a housing for a bearing 76, for example comprising an aperture 37 arranged to receive a bearing 76.

In some embodiments, a latch 40 comprises a first bearing 76 and a second bearing 77 arranged to collectively support a roller 48. In some embodiments, the first bearing 76 receives a first end of the roller 48 and the second bearing 77 receives a second end of the roller 48. In some embodiments, the two bearings 76, 77 support the roller 48 on opposite sides of the latch sear 42 portion of the roller 48. In some embodiments, a latch 40 comprises a first aperture 49 arranged to support a first bearing 76 and a second aperture **49*b* arranged to support a second bearing 77. In some embodiments, the first aperture 49 and second aperture 49*b* comprise mirrored shapes arranged on opposite sides of the latch sear 42**.

Figure 16:
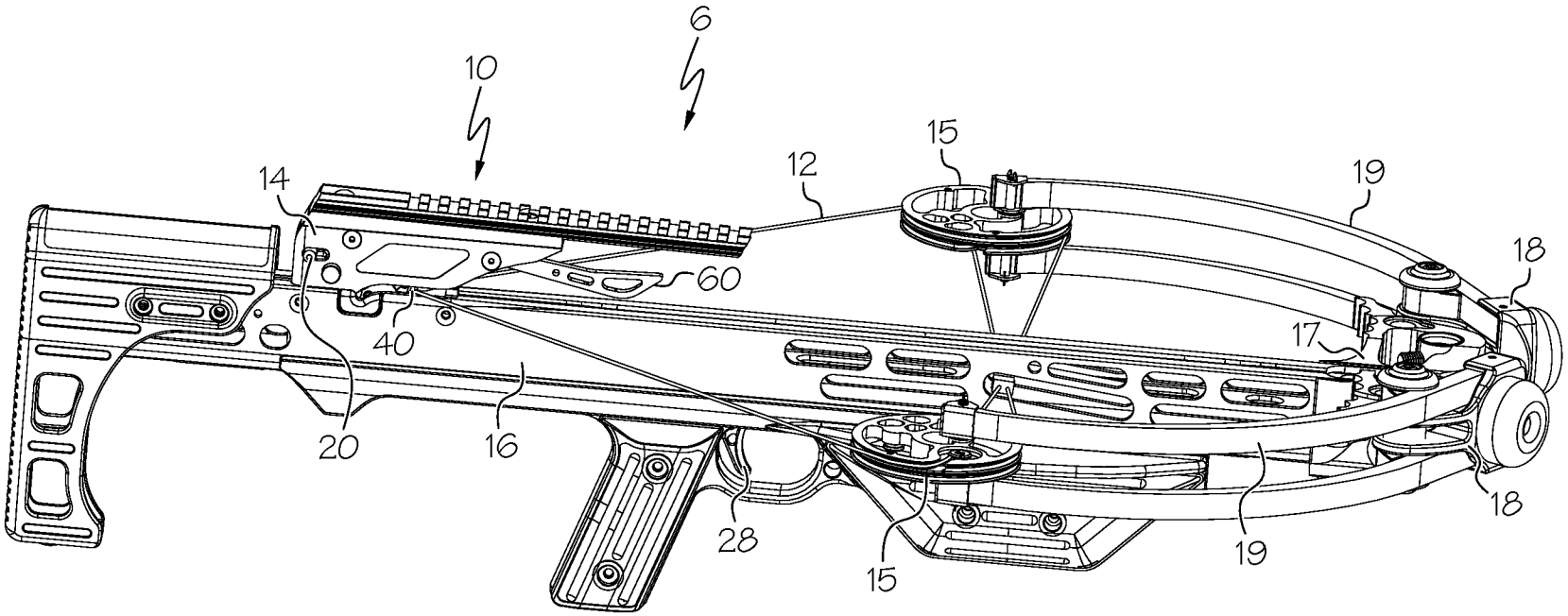
FIG. 16 shows an embodiment of a crossbow.

FIG. 16 shows an embodiment of a crossbow 6 comprising a trigger assembly 10 as discussed herein. In some embodiments, a crossbow 6 comprises a stock 16, a prod 17, limb cups 18, limbs 19, rotatable members 15 and cables 13, for example as disclosed in US 2016/0138886.

Figure 17:
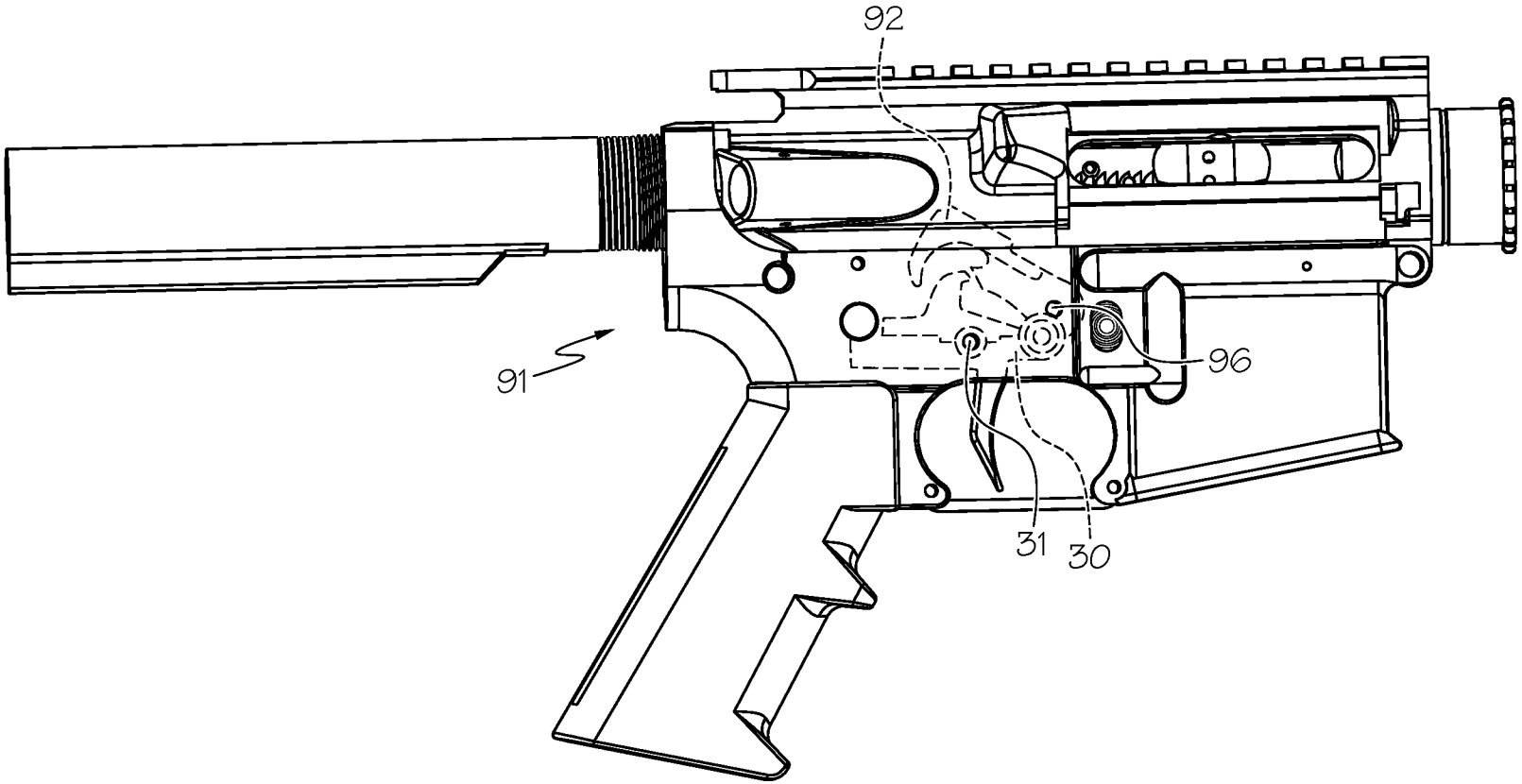
FIG. 17 shows an embodiment of a firearm.
Figure 18:
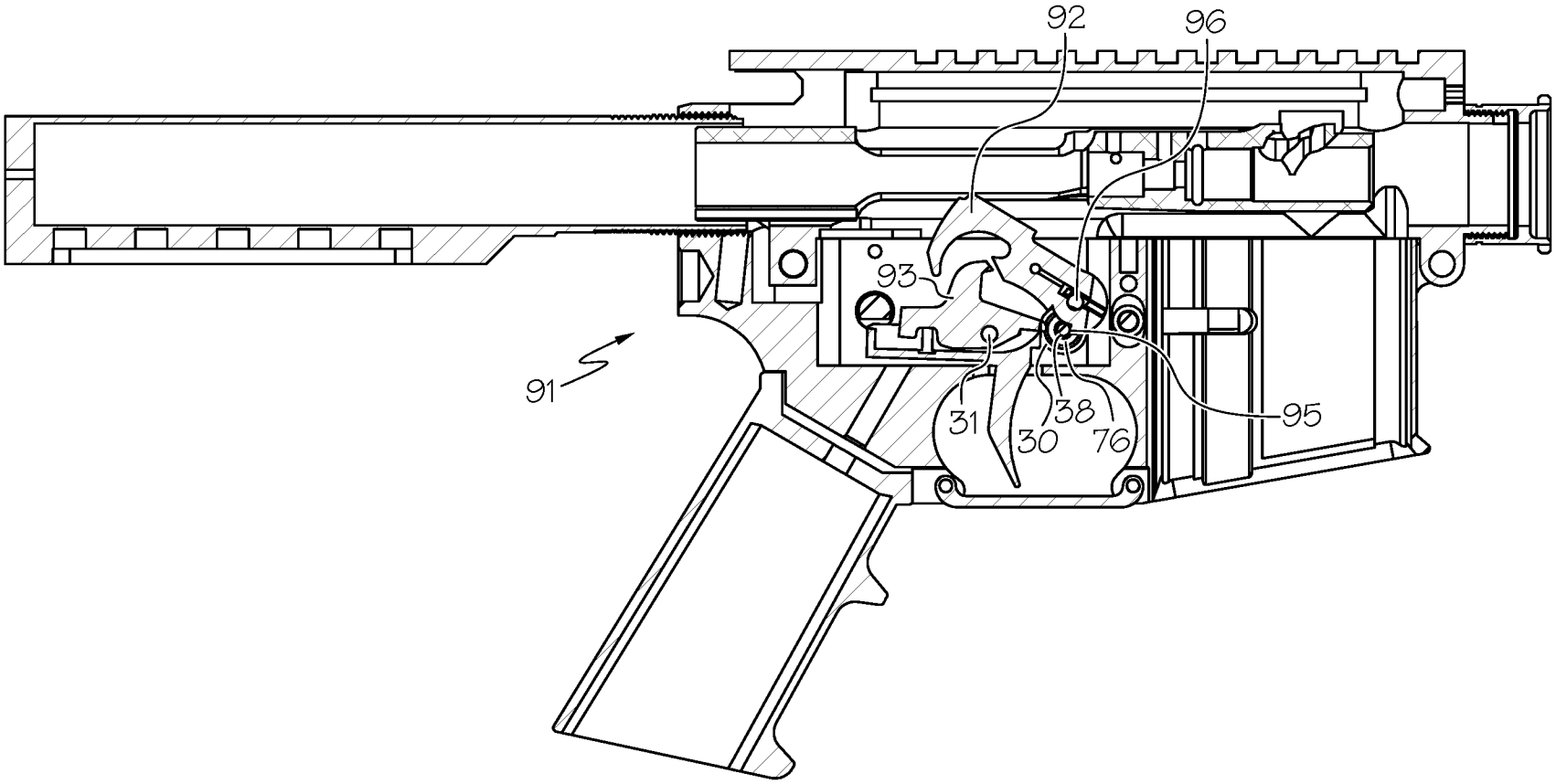
FIG. 18 shows a sectional view of an embodiment of a firearm.
Figure 19:
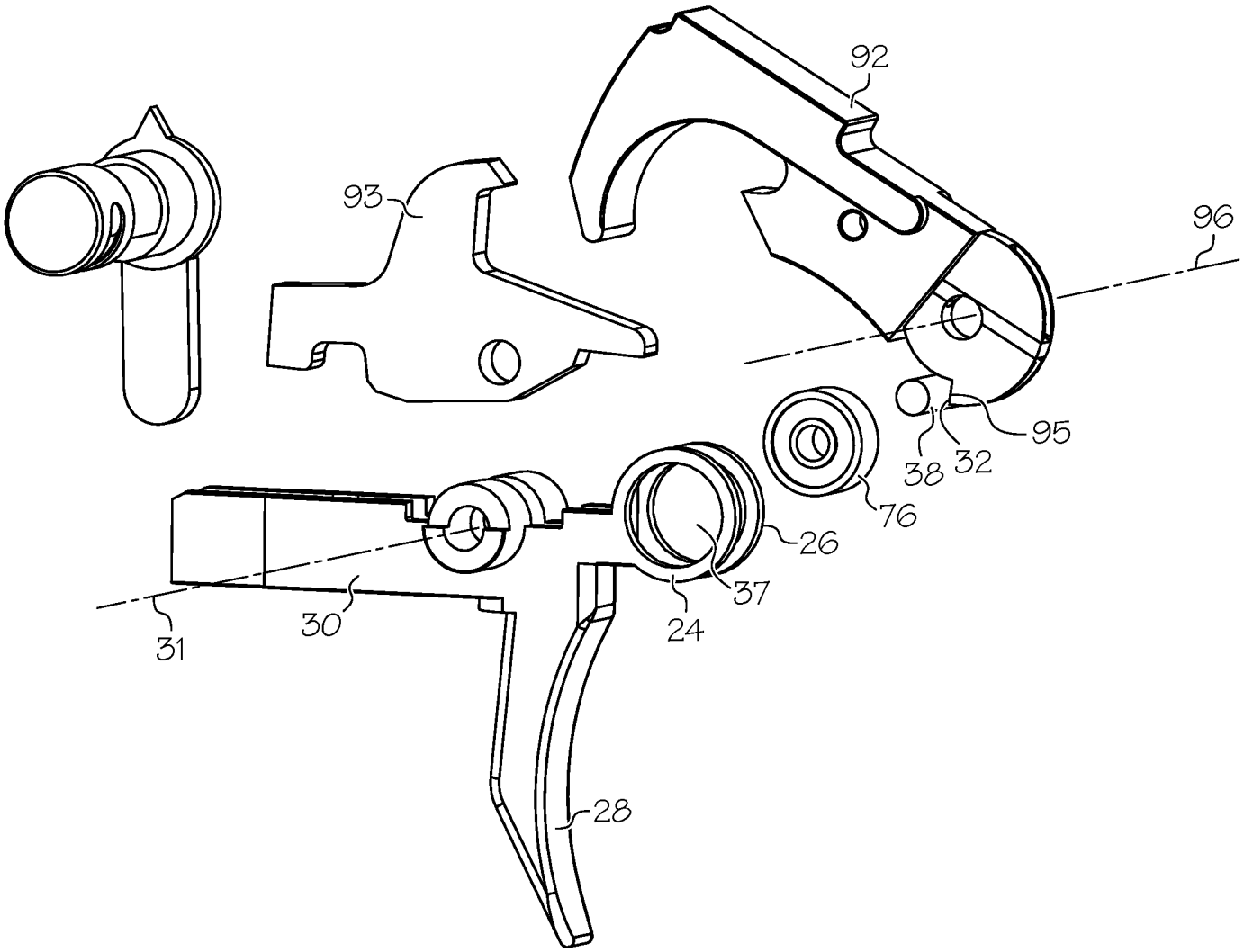
FIG. 19 shows an embodiment of trigger components.

FIG. 17 shows an embodiment of a firearm 91, comprising a trigger 30, a hammer 92 and a disconnector 93 housed in a lower receiver of the firearm. FIG. 18 shows a sectional view of an embodiment of a firearm 91, and FIG. 19 shows trigger components in greater detail.

The trigger 30 can support bearings 76, 77 as described herein, which support a roller 38 that comprises the trigger sear 32.

In some embodiments, the trigger 30 is supported by an axle and arranged to rotate about a trigger axis 31. In some embodiments, the disconnector 93 is supported by the trigger axle and arranged to rotate about the trigger axis 31.

In some embodiments, the hammer 92 is supported by a hammer axle and arranged to rotate about a hammer axis 96. Desirably, the hammer 92 is biased in a particular rotational direction by a biasing member, such as a hammer spring (not illustrated). Desirably, the hammer 92 comprises a hammer sear 95 that is arranged to contact the trigger sear 32. In some embodiments, the hammer sear 95 comprises a curved distal portion or surfaces oriented an angles to one another, as described herein.

The entire disclosures of U.S. Pat. Nos. 8,991,375, 9,068,791, 9,341,430 and 9,435,605, and US Patent Publication No. 2016/0138886 are hereby incorporated herein by reference.

The entire disclosure of US Application Attorney Docket No. 25049-US01 is hereby incorporated herein by reference.

In some embodiments, a trigger mechanism is described according to the following numbered paragraphs:

1. A firearm trigger assembly comprising:

a trigger arranged to pivot on a trigger axis, the trigger comprising a body, a bearing and a roller, the roller arranged to rotate with respect to the body, the roller comprising a trigger sear;

a hammer arranged to pivot on a hammer axis, the hammer comprising a hammer sear;

a hammer spring arranged to bias said hammer in a predetermined rotational direction;

wherein the trigger sear contacts the hammer sear.

2. The firearm trigger assembly of paragraph 1, said roller comprising a first portion in contact with said bearing and a second portion, said second portion comprising said trigger sear.

3. The firearm trigger assembly of paragraph 2, wherein said first portion and said second portion of said roller occupy different length portions of the roller.

4. The firearm trigger assembly of paragraph 1, said trigger comprising a second bearing, said body supporting the second bearing, the second bearing supporting the roller.

5. The firearm trigger assembly of paragraph 4, said roller comprising a first portion, a second portion and a third portion, said first portion in contact with said bearing, said second portion comprising said trigger sear, said third portion in contact with said second bearing.

6. The firearm trigger assembly of paragraph 5, wherein said second portion is located between said first portion and said third portion along a length of the roller.

7. The firearm trigger assembly of paragraph 1, said hammer sear comprising a curved surface.

8. The firearm trigger assembly of paragraph 7, wherein said curved surface is concave with respect to said roller.

9. The firearm trigger assembly of paragraph 1, said bearing comprising a roller bearing.

10. A trigger mechanism comprising:

a trigger comprising a trigger sear;

a latch comprising a body, a bearing and a roller, the roller arranged to rotate with respect to the body, the body supporting the bearing, the bearing supporting the roller, the roller comprising a latch sear, said latch sear arranged to contact said trigger sear.

11. The trigger mechanism of paragraph 10, said roller comprising a first portion in contact with said bearing and a second portion, said second portion comprising said latch sear.

12. The trigger mechanism of paragraph 11, wherein said first portion and said second portion of said roller occupy different length portions of the roller.

13. The trigger mechanism of paragraph 10, said latch comprising a second bearing, said body supporting the second bearing, the second bearing supporting the roller.

14. The trigger mechanism of paragraph 13, said roller comprising a first portion, a second portion and a third portion, said first portion in contact with said bearing, said second portion comprising said latch sear, said third portion in contact with said second bearing.

15. The trigger mechanism of paragraph 14, wherein said second portion is located between said first portion and said third portion along a length of the roller.

16. The trigger mechanism of paragraph 10, said trigger sear comprising a curved surface.

17. The trigger mechanism of paragraph 16, wherein said curved surface is concave with respect to said roller.

18. The trigger mechanism of paragraph 10, said trigger arranged to pivot on a trigger axis, said latch arranged to pivot on a latch access.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A crossbow trigger comprising:

a housing;

an arrow sensor moveable with respect to the housing;

an arrow retainer comprising a body arranged to pivot with respect to the housing; and a biasing member, said biasing member contacting said arrow sensor and contacting said arrow retainer.

2. The crossbow trigger of claim 1, said biasing member comprising a spring positioned between the arrow sensor and the arrow retainer.

3. The crossbow trigger of claim 2, the biasing member comprising a coil spring.

4. The crossbow trigger of claim 3, the arrow sensor comprising a protrusion arranged to engage the coil spring.

5. The crossbow trigger of claim 3, the arrow retainer comprising a protrusion arranged to engage the coil spring.

6. The crossbow trigger of claim 3, wherein moving the arrow sensor causes compression of the coil spring.

7. The crossbow trigger of claim 3, wherein moving the arrow retainer causes compression of the coil spring.

8. The crossbow trigger of claim 1, said arrow retainer comprising apertures.

9. The crossbow trigger of claim 1, the arrow sensor arranged to pivot with respect to the housing.

10. The crossbow trigger of claim 1, wherein moving the arrow retainer increases an amount of force applied to the arrow sensor by the biasing member.

11. A crossbow trigger comprising:

a housing;

an arrow sensor moveable with respect to the housing between a first position and a second position;

an arrow retainer moveable with respect to the housing between a first position and a second position; and a biasing member, the biasing member arranged to bias the arrow sensor to its first position, the biasing member arranged to bias the arrow retainer to its first position.

12. The crossbow trigger of claim 11, wherein moving the arrow retainer away from its first position increases an amount of force applied to the arrow sensor by the biasing member.

13. The crossbow trigger of claim 11, wherein moving the arrow sensor away from its first position increases an amount of force applied to the arrow retainer by the biasing member.

14. The crossbow trigger of claim 11, wherein the arrow retainer is pivotable with respect to the housing.

15. The crossbow trigger of claim 14, wherein the arrow sensor is pivotable with respect to the housing.

16. The crossbow trigger of claim 11, the biasing member comprising a compression spring.

17. The crossbow trigger of claim 11, the biasing member comprising a coil spring.

18. The crossbow trigger of claim 17, the arrow retainer comprising a protrusion arranged to engage a first end of the coil spring.

19. The crossbow trigger of claim 18, the arrow sensor comprising a protrusion arranged to engage a second end of the coil spring.

* * * * *